US010267209B2

(12) United States Patent
Kim et al.

(10) Patent No.: US 10,267,209 B2
(45) Date of Patent: Apr. 23, 2019

(54) FAN SHROUD FOR MOTOR VEHICLE

(71) Applicant: Hanon Systems, Daejeon (KR)

(72) Inventors: Jun Ho Kim, Daejeon (KR); Ok Ryul Min, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 384 days.

(21) Appl. No.: 15/003,260

(22) Filed: Jan. 21, 2016

(65) Prior Publication Data

US 2016/0208674 A1 Jul. 21, 2016

(30) Foreign Application Priority Data

Jan. 21, 2015 (KR) ..... 10-2015-0009960
Jan. 18, 2016 (KR) ..... 10-2016-0005806

(51) Int. Cl.

| | |
|---|---|
| ***F01P 5/06*** | (2006.01) |
| ***F04D 29/32*** | (2006.01) |
| ***F04D 29/52*** | (2006.01) |
| ***F04D 29/68*** | (2006.01) |

(52) U.S. Cl.

CPC ..... *F01P 5/06* (2013.01); *F04D 29/326* (2013.01); *F04D 29/526* (2013.01); *F04D 29/685* (2013.01)

(58) Field of Classification Search

CPC ..... F04D 29/00; F04D 29/326; F04D 29/40; F04D 29/52; F04D 29/526; F04D 29/54; F04D 29/541; F04D 29/542; F04D 29/545; F04D 29/547; F01P 5/00; F01P 5/06; F01P 11/00; F01P 11/10

USPC ..... 165/41, 121, 122, 135, 41.49

See application file for complete search history.

(56) References Cited

U.S. PATENT DOCUMENTS

| | | | | |
|---|---|---|---|---|
| 4,213,426 | A * | 7/1980 | Longhouse | F01P 5/06 123/41.49 |
| 4,398,508 | A * | 8/1983 | Moon | F01D 11/127 123/41.49 |
| 5,024,267 | A * | 6/1991 | Yamaguchi | F01P 5/06 123/41.49 |
| 6,579,063 | B2 * | 6/2003 | Stairs | F04D 29/326 416/169 A |
| 6,622,783 | B2 * | 9/2003 | Hitt | F01P 11/10 123/41.49 |
| 6,676,371 | B1 * | 1/2004 | Brown | F04D 29/023 123/41.49 |
| 6,874,990 | B2 * | 4/2005 | Nadeau | F04D 29/164 123/41.49 |
| 7,481,615 | B2 * | 1/2009 | Park | F04D 29/164 123/41.49 |
| 7,687,953 | B2 * | 3/2010 | Rahbar | F04D 25/0606 123/41.49 |

(Continued)

FOREIGN PATENT DOCUMENTS

JP H08260962 A 10/1996

*Primary Examiner* — Keith M Raymond
*Assistant Examiner* — Gustavo A Hincapie Serna
(74) *Attorney, Agent, or Firm* — Shumaker, Loop & Kendrick, LLP; James D. Miller

(57) ABSTRACT

A fan shroud assembly for a vehicle including a fan shroud for the vehicle which minimizes a noise generated by utilizing additional or supplemental flow spaces for smoothing air introduction to sections in which a vent hole of the shroud and a circumferential part of the shroud are adjacent each other.

15 Claims, 10 Drawing Sheets

(56) References Cited

U.S. PATENT DOCUMENTS

| | | | | |
|---|---|---|---|---|
| 7,789,622 | B2 * | 9/2010 | Acre | F04D 29/164<br>415/209.3 |
| 8,221,074 | B2 * | 7/2012 | Nelson | F04D 29/646<br>415/213.1 |
| 8,662,840 | B2 * | 3/2014 | Cote | F04D 29/547<br>415/220 |
| 9,714,666 | B2 * | 7/2017 | Schafer | F04D 29/164 |
| 9,829,010 | B2 * | 11/2017 | Yoshida | F04D 29/164 |
| 2007/0107677 | A1 * | 5/2007 | Ito | B62D 25/084<br>123/41.49 |
| 2008/0072851 | A1 * | 3/2008 | McLennan | B29C 45/14016<br>123/41.49 |
| 2011/0067845 | A1 * | 3/2011 | Bishop | F04D 29/526<br>165/121 |

* cited by examiner

FAN SHROUD FOR MOTOR VEHICLE

CROSS-REFERENCE TO RELATED APPLICATIONS

This patent application claims priority under 35 U.S.C. § 119 to Korean Patent Application No. 10-2015-0009960, filed on Jan. 21, 2015, and Korean Patent Application No. 10-2016-0005806, filed on Jan. 18, 2016, in the Korean Intellectual. Property Office, the disclosure of each of which is incorporated herein by reference in its entirety.

TECHNICAL FIELD

The following disclosure relates to a fan shroud for a vehicle. More particularly, the following disclosure relates to a fan shroud for a vehicle capable of reducing noise by securing additional flow spaces for further smoothing air introduction in sections in which a vent hole of a shroud and a circumferential part of the shroud are adjacent to each other.

BACKGROUND

Generally, an engine room of a vehicle is provided with an engine, a cooling means for cooling the engine, an air conditioning device, and the like. The cooling device, which is to cool the engine of the vehicle, is configured to include a radiator for cooling a coolant of the engine and a fan shroud generating an air flow of the radiator to improve heat radiation efficiency of a surface of the radiator, thereby further promoting cooling efficiency of the coolant.

The fan shroud is configured to blow air to an air cooling type heat exchanger such as the radiator, a condenser, or the like, of the vehicle in order to promote heat radiation of the air cooling type heat exchanger, and is classified into a pusher type and a puller type depending on a form in which the heat exchanger is disposed.

The pusher type is a type in which an axial-flow fan is disposed at a front side of the vehicle of the heat exchanger to forcibly blow air from the front of the vehicle toward the rear of the vehicle. Since air-blowing efficiency of the pusher type for the heat exchanger is low, the pusher type is used in the case in which a margin space behind the heat exchanger within the engine room is narrow. On the other hand, the puller type is a type in which an axial-flow fan is disposed at a rear side of the vehicle of the heat exchanger to pull air of a front side of the vehicle of the heat exchanger, thereby allowing the air to pass through the heat exchanger. Since air-blowing efficiency of the puller type is relatively higher than that of the pusher type, the puller type has been used in most of vehicles.

FIG. 1 is a perspective view of a fan shroud F according to the related art, and FIG. 2 is a front view of the fan shroud F according to the related art. FIG. 3 is a cross-sectional view of an air flow narrow space on a shroud 30 taken along line A-A' of FIG. 2.

Referring to FIGS. 1 and 2, the fan shroud F fixed to a rear end of a heat exchanger in order to introduce air into the heat exchanger indicates an assembly of a fan 10 and a shroud 30, and is configured to include the fan 10 for air-blowing, a motor 20 for driving the fan 10, and the shroud 30 including a body 31 having a vent hole formed at the center thereof and a motor fixing part 32 fixing and supporting the motor 20 by a plurality of stators 33 extended from an inner peripheral surface of the vent hole in a radial direction.

In the fan shroud F having the configuration as described above, noise due to friction with air at the time of rotation of the fan 10 and rotation noise of the motor 20 are necessarily generated. Therefore, the development of a technology for reducing the noise due to the friction with the air by changing a shape of the fan 10 or a shape of the shroud 30 has been actively conducted.

Here, as illustrated in FIG. 2, the fan 10 of the fan shroud F has a circular shape, and the shroud 30 of the fan shroud F has a quadrangular shape in order to enclose the heat exchanger having a quadrangular shape, such that a distance between the vent hole and a circumferential part of the body 31 is short at upper and lower sides of the vent hole and is relatively long at left and right sides of the vent hole. That is, the body 31 may be divided into diagonal regions in which a length between the vent hole and the circumferential part of the body 31 is a first length L1 that is long, upper and lower regions 31*b* in which a length between the vent hole and the circumferential part of the body 31 is a second length L2 that is short, and left and right regions 31*a* in which a length between the vent hole and the circumferential part of the body 31 is a length between the first length L1 and the second length L2.

Here, as illustrated in FIG. 3, a portion from a distal end of the vent hole to the circumferential part of the body 31 is inclined in order to smooth a flow of air, thereby reducing overall noise depending on the flow of the air.

However, since the length between the vent hole and the circumferential part of the body 31 is relatively short in the upper and lower regions 31*b*, narrow spaces A1, which are narrow air flow spaces, are present, and the flow of the air is not smooth in the narrow spaces A1, which mainly causes blade pass frequency (BPF) noise.

The BPF noise is repetitive noise of a high range generated at the time of rotation of the fan, and even though the overall noise is reduced, in the case in which the BPF noise is generated, sensitive quality of a user is not satisfied. Therefore, recently, the development of a technology for reducing the BPF noise has been demanded.

SUMMARY

An embodiment of the present invention is directed to providing a fan shroud for a vehicle capable of reducing noise by forming additional flow spaces protruding toward a rear side of the vehicle in sections in which a vent hole of a shroud and a circumferential part of a body are short to smooth a flow of air introduced into the shroud.

In one general aspect, a fan shroud for a vehicle fixed to a rear end of a heat exchanger for the vehicle in order to introduce cooling air into the heat exchanger, includes: a fan 100 for air-blowing; a driving motor 200 driving the fan 100; a shroud 300 or 600 including a body 310 or 610 having a vent hole formed at the center thereof and a motor fixing part 320 or 620 fixing and supporting the driving motor 200 by a plurality of stators 330 or 630 extended from an inner peripheral surface of the vent hole in a radial direction; and an additional flow space 500 formed by allowing a predetermined region of the body 310 or 610 in which an outer peripheral edge of the vent hole and a circumferential part of the body 310 or 610 are adjacent to each other to protrude toward the rear of the vehicle so that an extension space A2 is formed inside the shroud 300 or 600 in which the outer peripheral edge of the vent hole and the circumferential part of the body 310 or 610 are adjacent to each other.

One or more additional flow spaces 500 may be formed in upper and lower adjacent parts 312 or 612 in which the outer peripheral edge of the vent hole and upper and lower circumferential parts of the body 310 or 610 are adjacent to each other or left and right adjacent parts 311 or 611 in which the outer peripheral edge of the vent hole and one side and the other side of the body 310 or 610 in a width direction of the vehicle are adjacent to each other.

The additional flow space 500 may include: a horizontal part 313 extended from the circumferential part of the body 310 toward the rear of the vehicle; and a vertical part 314 extended from the outer peripheral edge of the vent hole outward in a height direction or a width direction of the vehicle.

When the longest length among lengths from the outer peripheral edge of the vent hole to the circumferential part of the body 310 or 610 is defined as a first length L10 and a distance from the outer peripheral edge of the vent hole in a region in which the additional flow space 500 is formed to the circumferential part of the body 310 or 610 is defined as a second length L20, the second length L20 may be 70% or less of the first length L10.

In the case in which the body 610 of the shroud 600 has a shape similar to a square shape or in the case in which a ratio between a short length and a long length in a horizontal length of the body 610 of the shroud (length in the width direction of the vehicle) and a vertical length of the body 610 of the shroud (length in a height direction of the vehicle) is 1:1.2 or less, an angle formed by a straight line connecting one end of the additional flow space 500 formed in the upper and lower adjacent parts 612 and the center of the vent hole to each other and a straight line connecting the other end of the additional flow space 500 formed in the upper and lower adjacent parts 612 and the center of the vent hole to each other or an angle formed by a straight line connecting one end of the additional flow space 500 formed in the left and right adjacent parts 611 and the center of the vent hole to each other and a straight line connecting the other end of the additional flow space 500 formed in the left and right adjacent parts 611 and the center of the vent hole to each other may be 30 to 80 degrees, and may be, preferably 30 to 60 degrees.

In the case in which the body 310 of the shroud 300 has a shape similar to a rectangular shape or in the case in which a ratio between a short length and a long length in a horizontal length of the body 310 of the shroud (length in the width direction of the vehicle) and a vertical length of the body 310 of the shroud (length in a height direction of the vehicle) exceeds 1:1.2, an angle formed by a straight line connecting one end of the additional flow space 500 formed in the upper and lower adjacent parts 312 and the center of the vent hole to each other and a straight line connecting the other end of the additional flow space 500 formed in the upper and lower adjacent parts 312 and the center of the vent hole to each other is 30 to 80 degrees, and may be, preferably, 30 to 60 degrees, and an angle formed by a straight line connecting one end of the additional flow space 500 formed in the left and right adjacent parts 311 and the center of the vent hole to each other and a straight line connecting the other end of the additional flow space 500 formed in the left and right adjacent parts 311 and the center of the vent hole to each other may be 20 to 60 degrees, and may be, preferably, 20 to 40 degrees.

A first inclined part 315 having a predetermined curvature may be formed between the horizontal part 313 and the vertical part 314, and the first inclined part 315 may have a curvature smaller than that of the body 310.

Second inclined parts 316 of which a curvature is continuously varied may be formed at both ends of the additional flow space 500 in a length direction in a boundary region between the additional flow space 500 and the body 310.

A waveform part 400 having a wave shape may be formed in a length direction at a lower end of the additional flow space 500.

The waveform part 400 may have a form in which it is inclined at a predetermined angle with respect to a flow direction of the cooling air.

A plurality of protrusions 601 may be formed on an inner wall of the additional flow space 500.

Sizes and arrays of the plurality of protrusions 601 may be irregular.

DETAILED DESCRIPTION OF MAIN ELEMENTS

Figure 1:
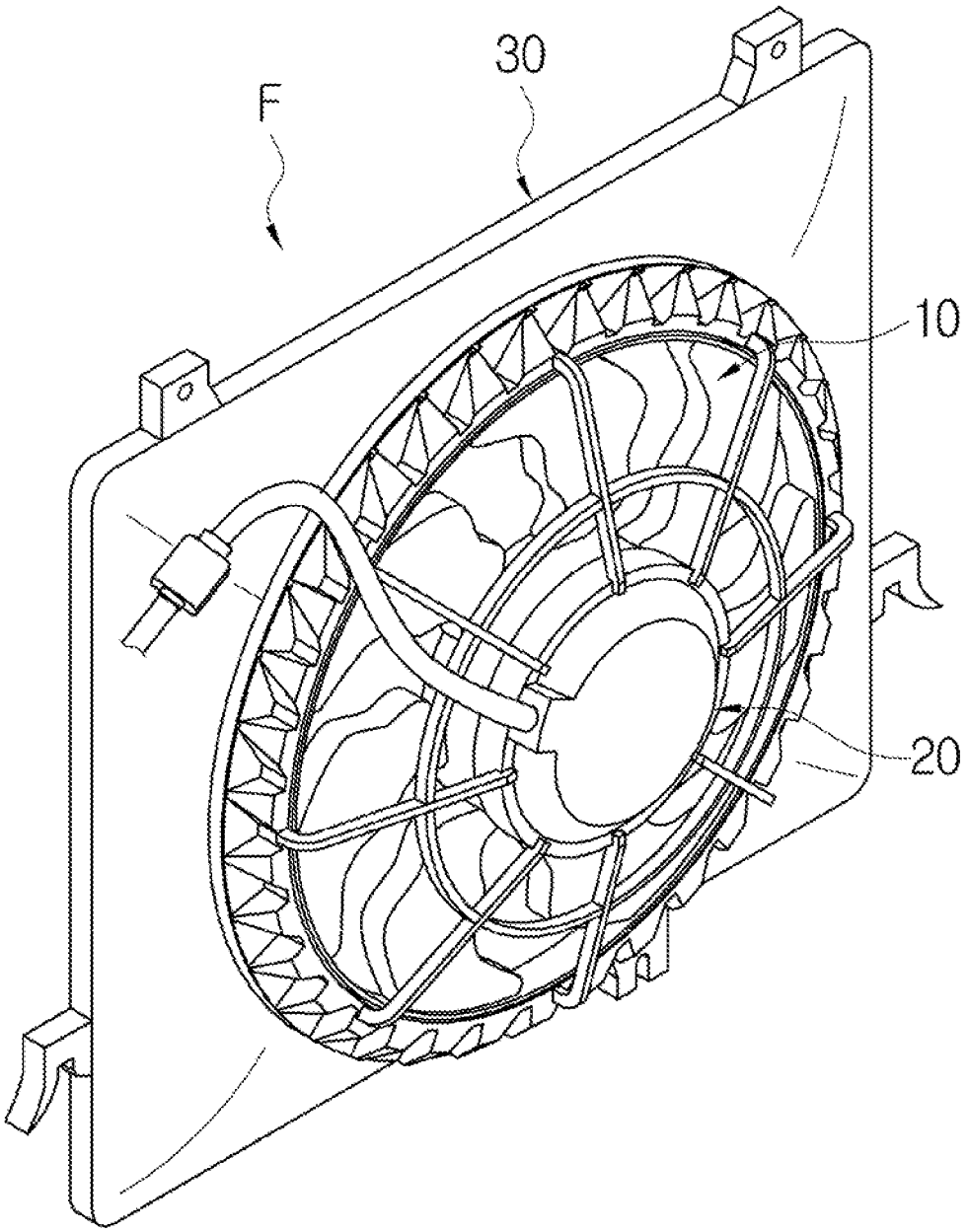
FIG. 1 PRIOR ART
FIG. 1 is a perspective view of a fan shroud according to the related art.
Figure 2:
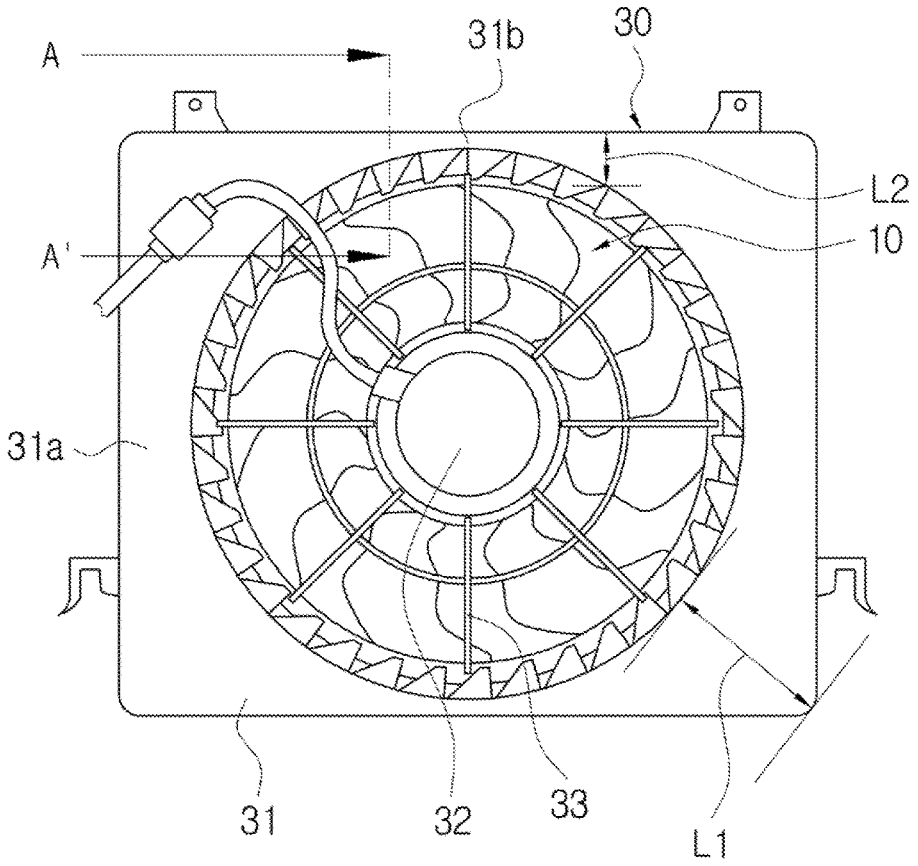
FIG. 2 PRIOR ART
FIG. 2 is a front view of the fan shroud according to the related art.
Figure 3:
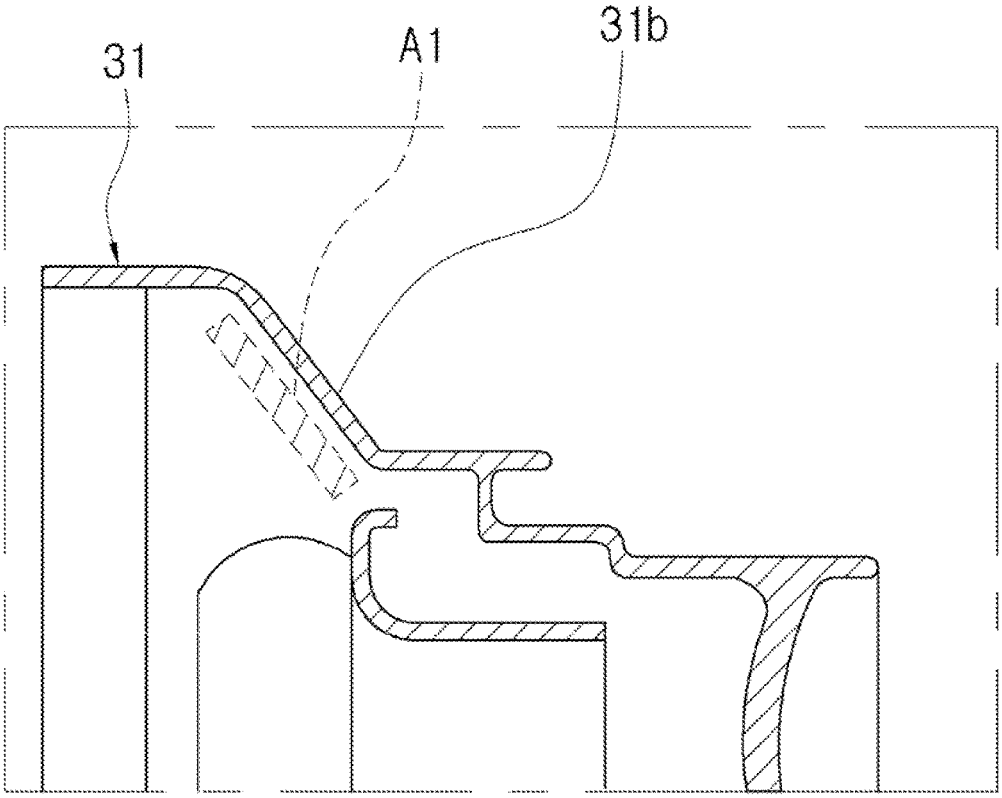
FIG. 3 PRIOR ART
FIG. 3 is a cross-sectional view taken along line A-A' of FIG. 2.

F: fan shroud
100: fan
200: driving motor
300: shroud
310: body
311: left and right adjacent parts
312: upper and lower adjacent parts
313: horizontal part
314: vertical part
315: inclined part
320: motor fixing part
330: stator
400: waveform part
500: additional flow space
510: first additional flow space
520: second additional flow space
601: protrusion
L10: first length
L20: second length

DETAILED DESCRIPTION OF EMBODIMENTS

Hereinafter, an exemplary embodiment of the present invention will be described in detail with reference to the accompanying drawings.

Figure 4:
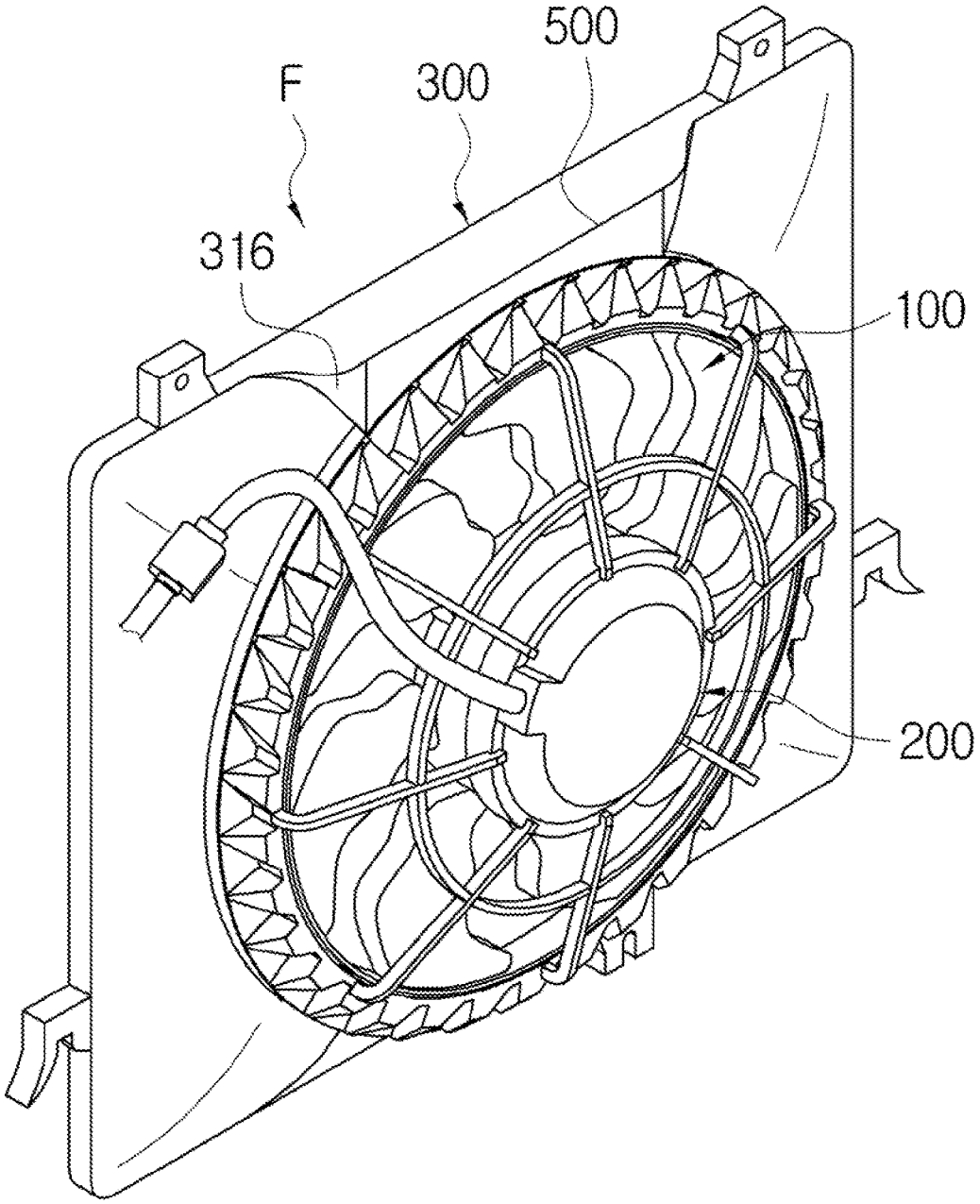
FIG. 4 is a perspective view of a fan shroud according to a first exemplary embodiment of the present invention.
Figure 5:
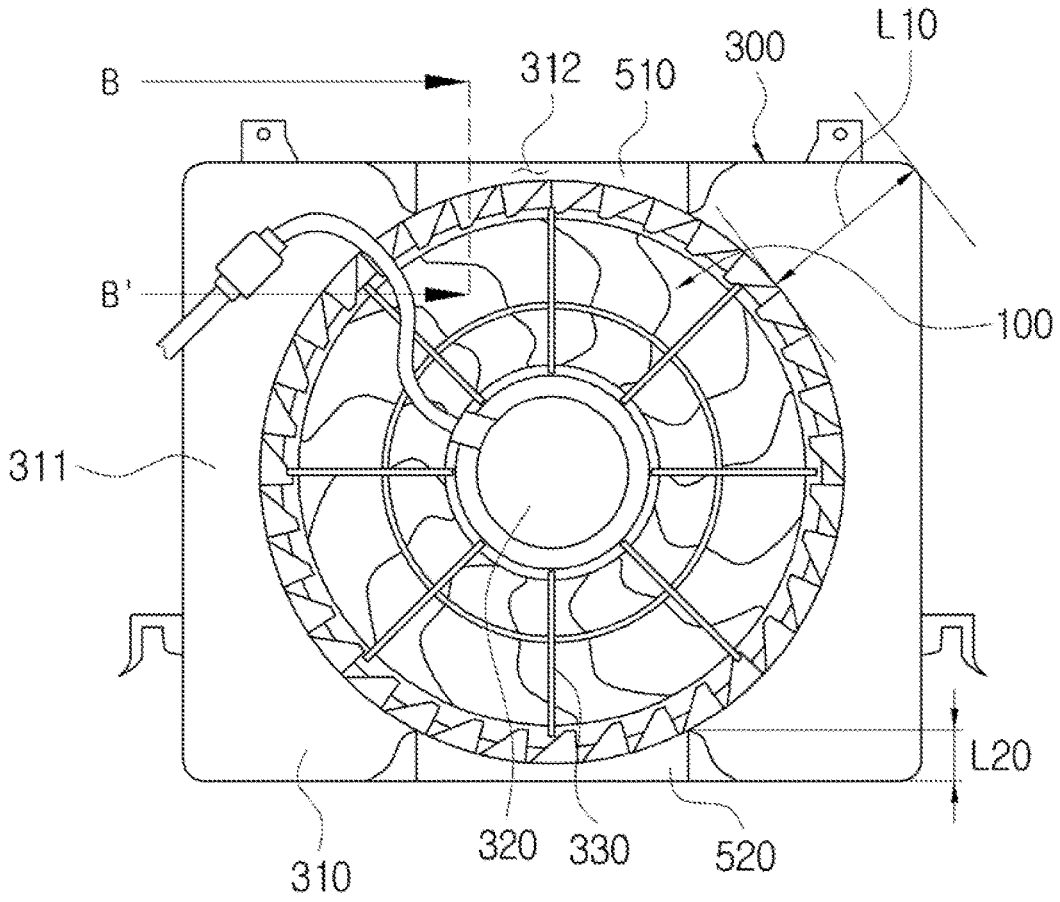
FIG. 5 is a front view of the fan shroud according to a first exemplary embodiment of the present invention.

An entire perspective view of a fan shroud F according to a first exemplary embodiment of the present invention is illustrated in FIG. 4, and a front view of the fan shroud F according to a first exemplary embodiment of the present invention is illustrated in FIG. 5. In addition, a cross-sectional view illustrating a detailed shape of additional or supplemental flow spaces 510 and 520 according to a first exemplary embodiment of the present invention, taken along line B-B' of FIG. 5.

As illustrated in FIGS. 4 and 5, the fan shroud F according to the present exemplary embodiment is fixed to a rear end of a heat exchanger in order to introduce cooling air into the heat exchanger, and includes a driving motor 200 fixed to a shroud 300 having a vent hole, and a fan 100 rotatably connected to the driving motor 200.

Since the fan 100 according to the present invention may be an axial-flow fan that is generally used, a detailed description for the fan 100 will be omitted.

The driving motor 200, which is a driving source allowing air-blowing to be performed while rotating the fan 100 in the same direction in order to cool a heat exchange medium passing through an inner portion of the heat exchanger of a vehicle, may be a motor driven by general direct current (DC) or alternating current (AC).

The shroud 300 is a member guiding the air-blowing generated by the rotation of the fan 100 by the driving motor 200 and fixed to the heat exchanger of the vehicle in a state in which it supports the driving motor 200, which is the driving source.

The shroud 300 has the vent hole formed at the center thereof in order to guide the sucked blown air in an axial direction, and includes a body 310 having a quadrangular shape corresponding to a shape of the heat exchanger so that a rear surface thereof may contact the entire rear surface of the heat exchanger and formed of a synthetic resin. Here, the vent hole of the shroud 300 may be formed in a circular shape in order to reduce wind pressure loss to improve air-blowing efficiency.

In addition, the shroud 300 is provided with a motor fixing part 320 fixing and supporting the driving motor 200 disposed at the center of the vent hole in a state in which it is supported and formed by a plurality of stators 330 extended from a plurality of points of an inner peripheral surface of the vent hole in a centrifugal or radial direction.

Here, the fan shroud F according to the present invention includes additional or supplemental flow spaces 500 formed in order to smooth a flow of air at an inner side of the body 310 of left and right adjacent parts 311 or upper and lower adjacent parts 312 in which an inner peripheral edge of the vent hole and a circumferential part of the body 310 are adjacent to each other.

The additional flow spaces 500 includes a first additional or supplemental flow space 510 formed between the inner peripheral edge of the vent hole and an upper end of the center of the body 310 in a width direction of the vehicle, and a second additional or supplemental flow space 520 formed between the inner peripheral edge of the vent hole and a lower end of the center of the body 310 in the width direction of the vehicle.

Although an example in which a pair of additional flow spaces 500 is formed in the upper and lower adjacent parts 312, respectively, has been illustrated in the present exemplary embodiment, a pair of additional flow spaces 500 may also be formed in the left and right adjacent parts 311, respectively, in the case in which the body 310 has a shape similar to a square shape, such that the left and right adjacent parts 311 of left and right circumferential parts of the center of the body 310 in a height direction of the vehicle and the inner peripheral edge of the vent hole are adjacent to each other. This will be described later with reference to the accompanying drawings.

The first additional flow space 510 and the second additional flow space 520 have the same shape and are disposed to face each other. Therefore, hereinafter, a shape of the first additional flow space 510 will be described in detail.

Figure 6:
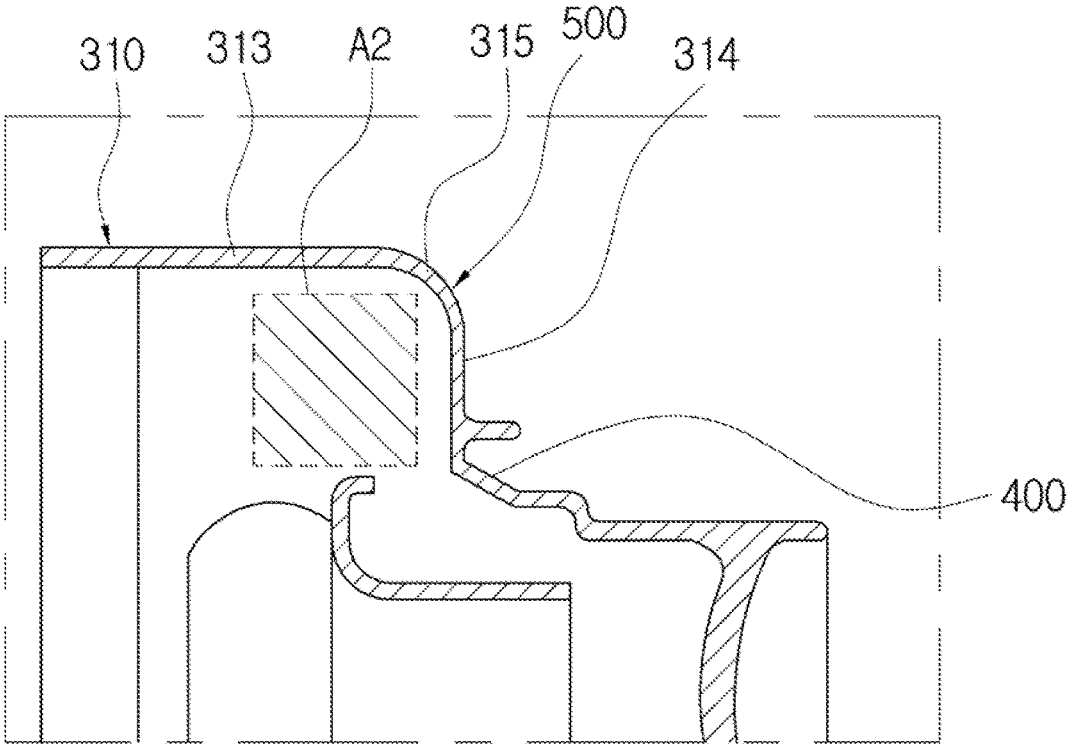
FIG. 6 is a cross-sectional view taken along line B-B' of FIG. 5.

Referring to FIG. 6, the additional flow spaces 500 include a horizontal part 313 extended from the upper and lower adjacent parts 312 toward the rear of the vehicle so that extension spaces A2 are formed inside upper and lower circumferential parts of the center of the body 310 in the width direction of the vehicle, and a vertical part 314 extended from the inner peripheral edge of the vent hole toward the top or the bottom of the vehicle.

Here, a first inclined part 315 having a predetermined curvature is formed on a boundary between the horizontal part 313 and the vertical part 314. The first inclined part 315 is formed along a length direction of the additional flow space 500. The first inclined part 315 has a curvature smaller than that of the body 310. The curvature of the body 310 may be defined as a curvature of a straight line connecting an outer peripheral edge of the vent hole on the body 310 and a distal end of the circumferential part of the body 310 to each other.

The extension space A2 is formed through the additional flow space 500, such that a flow of air passing through the extension space A2 becomes smooth. The flow of the air is smoothed, such that blade pass frequency (BPF) noise due to air friction may be reduced.

In addition, as illustrated in FIG. 4, second inclined parts 316 of which a curvature is continuously varied are formed at both ends of the additional flow space 500 in the length direction in a boundary region between the additional flow space 500 and the body 310.

When the longest length among the lengths from the outer peripheral edge of the vent hole to the distal end of the circumferential part of the body 310 is defined as a first length L10 and a length from the outer peripheral edge of the vent hole in a region in which the additional flow space 500 is formed to the distal end of the circumferential part of the body 310 is defined as a second length L20, the second length L20 may be 70% or less of the first length L10.

That is, when it is assumed that the longest length among the lengths from the outer peripheral edge of the vent hole to the distal end of the circumferential part of the body 310 is 100 cm, the additional flow space 500 may be formed in a region in which the length from the outer peripheral edge of the vent hole to the distal end of the circumferential part of the body 310 is 70 cm or less.

The reason is that in the case in which the additional flow space 500 is formed in a region in which the length from the outer peripheral edge of the vent hole to the distal end of the circumferential part of the body exceeds 70 cm, the additional flow space 500 is also formed in a region in which a space in which the blown air may sufficiently smoothly flow is secured, such that overall noise may be increased.

Figure 7:
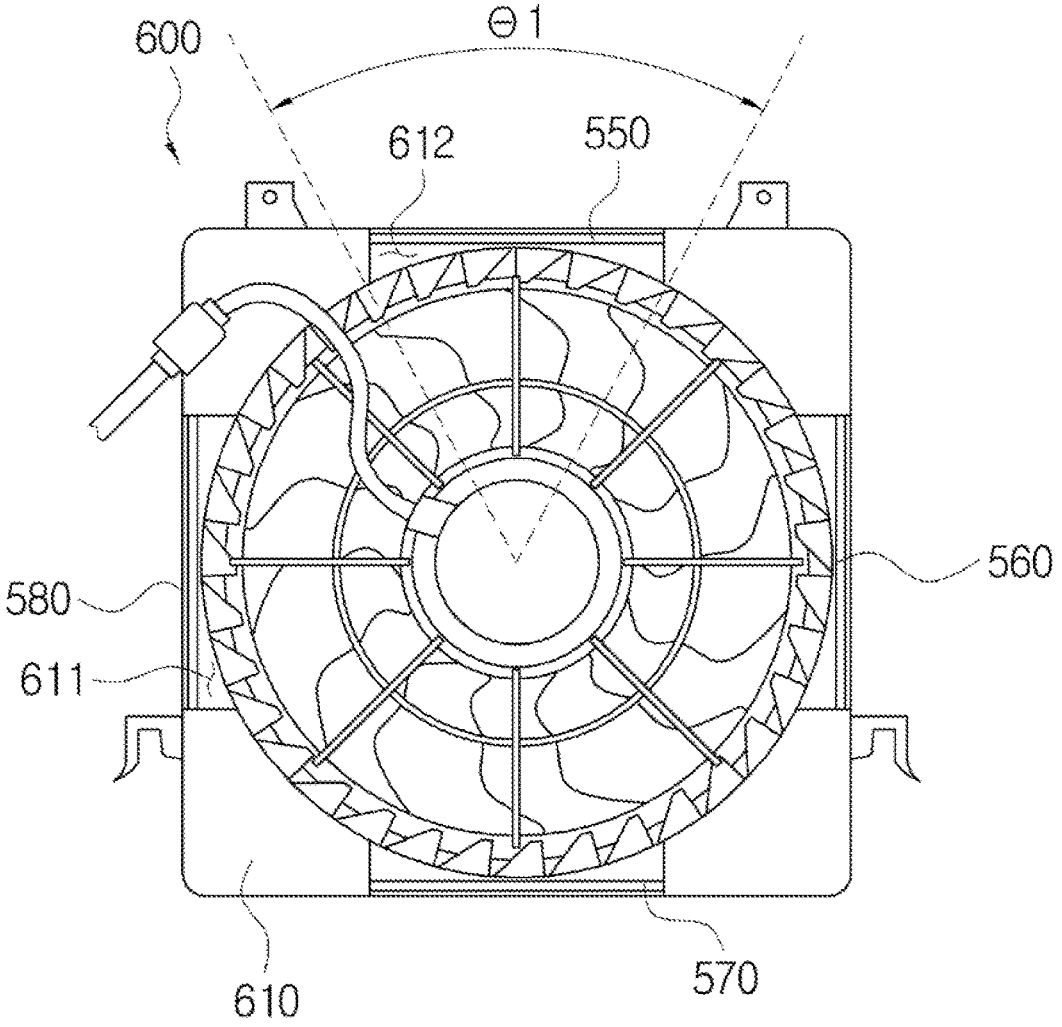
FIG. 7 is a front view of a fan shroud according to a second exemplary embodiment of the present invention.

A front view of a fan shroud 600 according to a second exemplary embodiment of the present invention is illustrated in FIG. 7.

As illustrated in FIG. 7, in the case in which a body 610 of the fan shroud 600 has a square shape, narrow spaces in which a distance between a vent hole and a circumferential part of the body is short, such that a flow of air is not actively made, may be formed at left and right sides of the body 610 as well as upper and lower sides of the body 610. In this case, a pair of additional flow spaces 500 may be formed at the left and right sides of the body 610 as well as the upper and lower sides of the body 610, respectively.

That is, one or more additional flow spaces 500 may be formed in upper and lower adjacent parts 612 in which the outer peripheral edge of the vent hole and the upper and lower circumferential parts of the body 610 are adjacent to each other or left and right adjacent parts 611 in which the outer peripheral edge of the vent hole and one side and the other side of the body 610 in the width direction of the vehicle are adjacent to each other.

In a second exemplary embodiment of the present invention, a first additional or supplemental flow space 550 formed at an upper side 612 of the body 610, a second additional or supplemental flow space 570 formed at a lower side of the body, a third additional or supplemental flow space 560 formed at one side of the body 610 in the width direction of the vehicle, and a fourth additional or supplemental flow space 580 formed at the other side 611 of the body 610 in the width direction of the vehicle are included.

As illustrated in FIG. 7, an angle (θ1) from the center of the vent hole of the body 610 may be used in defining regions of the additional flow spaces 500. In the case in which the body 610 of the shroud has a shape similar to a square shape or in the case in which a ratio between a short length and a long length in a horizontal length of the body 610 of the shroud (length in the width direction of the vehicle) and a vertical length of the body 610 of the shroud (length in the height direction of the vehicle) is 1:1.2 or less, an angle θ1 formed by a straight line connecting one end of the first or second additional flow space 550 or 570 formed in the upper and lower adjacent parts 612 and the center of the vent hole to each other and a straight line connecting the other end of the first or second additional flow space 550 or 570 formed in the upper and lower adjacent parts 612 and the center of the vent hole to each other or an angle formed by a straight line connecting one end of the third or fourth additional flow space 560 or 580 formed in the left and right adjacent parts 611 and the center of the vent hole to each other and a straight line connecting the other end of the third or fourth additional flow space 560 or 580 formed in the left and right adjacent parts 611 and the center of the vent hole to each other is 30 to 80 degrees, and is preferably 30 to 60 degrees. In the case in which the angle is 30 degrees or less in regions in which the additional flow spaces 500 are formed, a noise preventing effect is reduced, and in the case in which the angle is larger than 60 degrees in regions in which the additional flow spaces 500 are formed, a reverse effect that introduction of air into the fan is hindered occurs.

Figure 8:
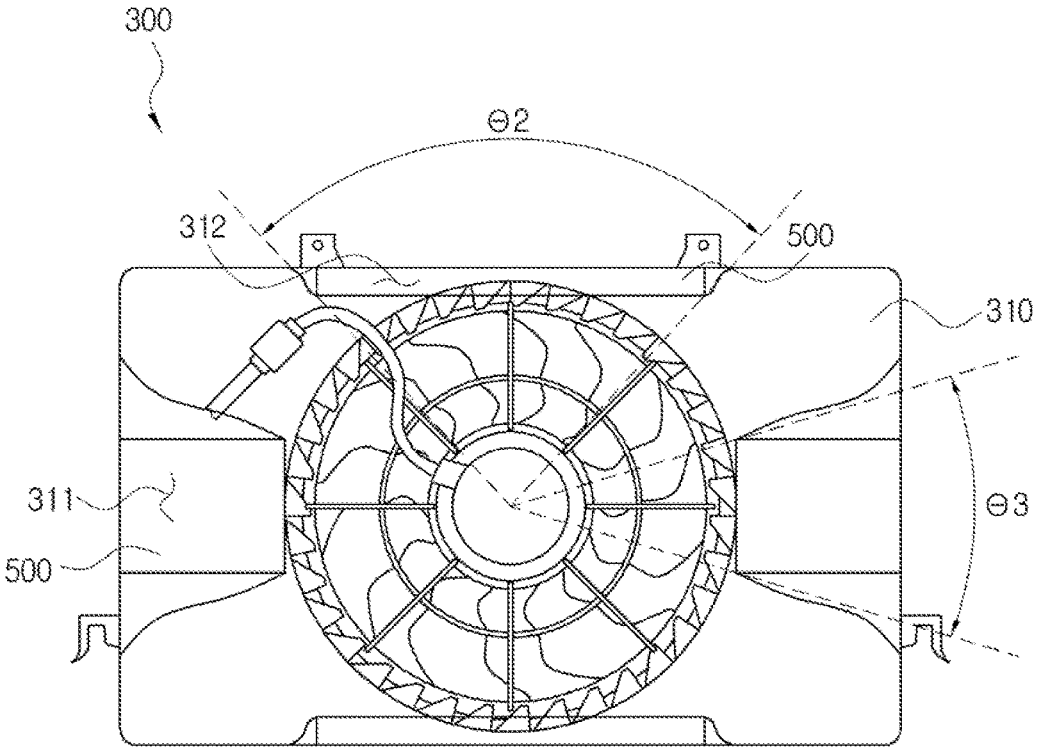
FIG. 8 is a view illustrating an additional flow space region of a fan shroud according to the present invention.

Meanwhile, as illustrated in FIG. 8, in the case in which the body 310 of the shroud has a shape similar to a rectangular shape or in the case in which a ratio between a short length and a long length in a horizontal length of the body 310 (length in the width direction of the vehicle) and a vertical length of the body 310 (length in the height direction of the vehicle) exceeds 1:1.2, an angle θ2 formed by a straight line connecting one end of the additional flow space 500 formed in the upper and lower adjacent parts 312 and the center of the vent hole to each other and a straight line connecting the other end of the additional flow space 500 formed in the upper and lower adjacent parts 312 and the center of the vent hole to each other is 30 to 80 degrees, and is, preferably, 30 to 60 degrees. In the case in which the angle is 30 degrees or less in regions in which the additional flow spaces 500 are formed, a noise preventing effect is reduced, and in the case in which the angle is larger than 60 degrees in regions in which the additional flow spaces 500 are formed, a reverse effect that introduction of air into the fan is hindered occurs.

In addition, an angle θ3 formed by a straight line connecting one end of the additional flow space 500 formed in the left and right adjacent parts 311 and the center of the vent hole to each other and a straight line connecting the other end of the additional flow space 500 formed in the left and right adjacent parts 311 and the center of the vent hole to each other is 20 to 60 degrees, and is, preferably, 20 to 40 degrees. In the case in which the angle is 20 degrees or less in regions in which the additional flow spaces 500 are formed, a noise preventing effect is reduced, and in the case in which the angle is larger than 40 degrees in regions in which the additional flow spaces 500 are formed, a reverse effect that introduction of air into the fan is hindered occurs.

Figure 9:
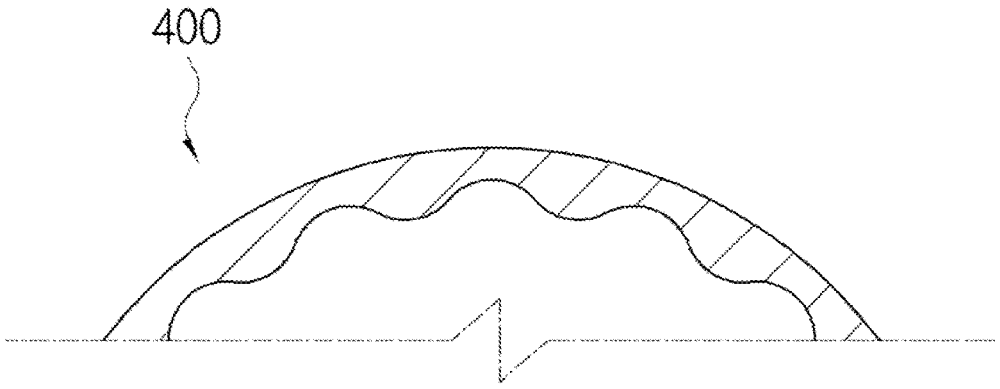
FIG. 9 is a cross-sectional view of a waveform part of a fan shroud according to a third exemplary embodiment of the present invention.
Figure 10:
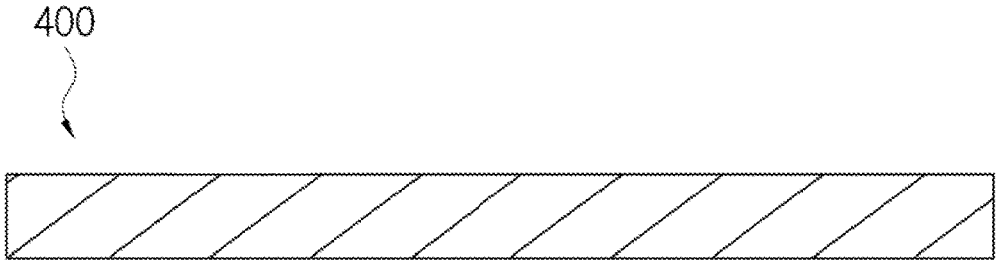
FIG. 10 is a plan view of an inner peripheral surface of a vent hole illustrating the waveform part according to a third exemplary embodiment of the present invention.

A cross-sectional view of a waveform part 400 of an additional flow space 500 of a fan shroud F according to a third exemplary embodiment of the present invention is illustrated in FIG. 9, and a plan view of an inner peripheral surface of a vent hole illustrating the waveform part 400 of the fan shroud F according to a third exemplary embodiment of the present invention is illustrated in FIG. 10. Referring to FIGS. 6, 9, and 10, a waveform part 400 is formed at a lower end of the additional flow space 500. The waveform part 400 is formed in a length direction of the additional flow space 500, and has a wave shape. The waveform part 400 is configured to guide cooling air flowing along the additional flow space 500 in order to smoothly discharge the cooling air. Particularly, the waveform part 400 has a form in which it is inclined at a predetermined angle with respect to a flow direction of the cooling air. Fluidity of the cooling air flowing along the additional flow space 500 is improved through the configuration as described above, thereby making it possible to minimize noise and vibrations generated due to the cooling air flowing along the additional flow space 500.

Figure 11:
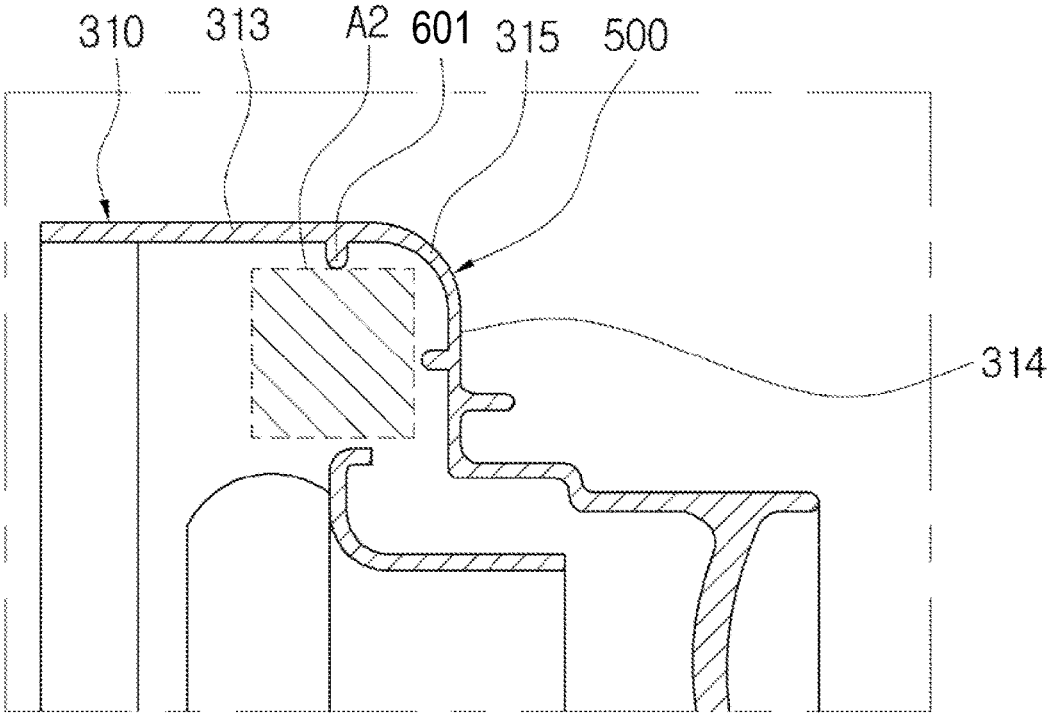
FIG. 11 is a cross-sectional view of an additional flow space of a fan shroud according to a fourth exemplary embodiment of the present invention.

A cross-sectional view of an additional flow space 500 of a fan shroud F according to a fourth exemplary embodiment of the present invention is illustrated in FIG. 11.

As illustrated in FIG. 10, protrusions 601 are formed on an inner wall of the additional flow space 500. The protrusions 601 protrude inward from the inner wall of the additional flow space 500. A plurality of protrusions 601 are disposed to be spaced apart from each other along the inner wall. In this case, sizes or arrays of the protrusions 601 may be irregular.

The cooling air flowing along the additional flow space 500 becomes a turbulent flow through the configuration of the protrusions 601 as described above, such that the cooling air flows at a constant speed and in a constant direction within the additional flow space 500, thereby making it possible to prevent resonance noise.

In the fan shroud for a vehicle according to the present invention having the configuration as described above, the narrow spaces in which the flow of the air within the shroud is not smooth are minimized, thereby minimizing the BPF noise of the fan shroud.

The present invention is not to be construed as being limited to the above-mentioned exemplary embodiment. The present invention may be applied to various fields and may be variously modified by those skilled in the art without departing from the scope of the present invention claimed in the claims. Therefore, it is obvious to those skilled in the art that these alterations and modifications fall in the scope of the present invention.

What is claimed is:

1. A fan shroud assembly for a vehicle, the fan shroud assembly fixed to a heat exchanger in a rear direction of the vehicle to introduce cooling air into the heat exchanger, the fan shroud assembly comprising:

a fan;

a driving motor driving the fan; and a shroud including a body having a vent hole providing a flow space formed at a center of the body, the shroud further including a plurality of stators extending radially inwardly from a surface forming the vent hole to a motor fixing part supporting the driving motor, wherein a supplemental flow space is formed between an outer peripheral edge of the body forming the vent hole and a circumferential part of the body, wherein an extension space is formed in the supplemental flow space where the outer peripheral edge and the circumferential part are adjacent each other and protrude toward the rear direction of the vehicle, wherein the supplemental flow space forms the extension space, the supplemental flow space including a horizontal part linearly extending a first distance from the circumferential part of the body in a horizontal direction toward the rear of the vehicle, a vertical part linearly extending outwardly a second distance from the outer peripheral edge of the body forming the vent hole in a height direction of the vehicle or a width direction of the vehicle, and a first inclined part extending between and connecting the horizontal part to the vertical part, the first inclined part having a predetermined and constant curvature as the first inclined part extends between the horizontal part and the vertical part, wherein a distance the horizontal part extends in the horizontal direction is greater than a distance the first inclined part extends in the horizontal direction, wherein a longest distance from the outer peripheral edge of the body forming the vent hole to the circumferential part of the body is defined as a first length, wherein a distance from the outer peripheral edge of the body forming the vent hole in a region where the supplemental flow space is formed to the circumferential part of the body is defined as a second length, and wherein the second length is 70% or less of the first length.

2. The fan shroud assembly according to claim 1, wherein a plurality of supplemental flow spaces is formed in the body.

3. The fan shroud assembly according to claim 2, wherein the plurality of supplemental flow spaces is formed in an upper part and a lower part of the body.

4. The fan shroud assembly according to claim 2, wherein the plurality of supplemental flow spaces is formed in a first side part and a second side part of the body.

5. The fan shroud assembly according to claim 1, wherein the first inclined part has a radius of curvature smaller than a radius of curvature of the body present between the circumferential part of the body and the outer peripheral edge of the body forming the vent hole.

6. The fan shroud assembly according to claim 5, further comprising a pair of second inclined parts having a curvature and formed in a boundary region between the supplemental flow space and the body, wherein a first one of the pair of second inclined parts is formed at a first end of the supplemental flow space and a second one of the pair of second inclined parts is formed at a second end of the supplemental flow space.

7. The fan shroud assembly according to claim 2, wherein a ratio between a horizontal length of the body in the width direction of the vehicle and a vertical length of the body in the height direction of the vehicle is 1:1.2 or less.

8. The fan shroud assembly according to claim 7, wherein an angle formed by a straight line connecting a first end of one of the supplemental flow spaces and a center of the vent hole and a straight line connecting a second end of the one of the supplemental flow spaces and the center of the vent hole is between 30 and 80 degrees.

9. The fan shroud assembly according to claim 8, wherein the one of the supplemental flow spaces is formed in one of an upper part of the body, a lower part of the body, a first side part of the body, and a second side part of the body.

10. The fan shroud assembly according to claim 2, wherein a ratio between a horizontal length of the body in the width direction of the vehicle and a vertical length of the body in the height direction of the vehicle is greater than 1:1.2.

11. The fan shroud assembly according to claim 10, wherein an angle formed by a straight line connecting a first end of one of the supplemental flow spaces formed in one of an upper part of the body and a lower part of the body and a center of the vent hole and a straight line connecting a second end of the one of the supplemental flow spaces formed in the one of the upper part of the body and the lower part of the body and the center of the vent hole is between 30 and 80 degrees, and wherein an angle formed by a straight line connecting a first end of one of the supplemental flow spaces formed in one of a left adjacent part of the body and a right adjacent part of the body and a center of the vent hole and a straight line connecting a second end of the one of the supplemental flow spaces formed in the one of the left adjacent part of the body and the right adjacent part of the body and the center of the vent hole is between 30 and 60 degrees.

12. The fan shroud assembly according to claim 1, wherein a waveform part having a wave shape is formed adjacent the vertical part of the supplemental flow space.

13. The fan shroud assembly according to claim 12, wherein the waveform part is inclined at a predetermined angle with respect to a flow direction of the cooling air.

14. The fan shroud assembly according to claim 1, wherein a plurality of protrusions is formed on an inner wall of the supplemental flow space.

15. A fan shroud assembly for a vehicle, the fan shroud assembly fixed to a heat exchanger in a rear direction of the vehicle to introduce cooling air into the heat exchanger, the fan shroud assembly comprising:

a fan;

a driving motor driving the fan; and a shroud including a body having a vent hole providing a flow space formed at a center of the body, the shroud further including a plurality of stators extending radially inwardly from a surface forming the vent hole to a motor fixing part supporting the driving motor, wherein a supplemental flow space is formed between an outer peripheral edge of the body forming the vent hole and a circumferential part of the body, wherein an extension space is formed in the supplemental flow space where the outer peripheral edge and the circumferential part are adjacent each other and protrude toward the rear direction of the vehicle, wherein the supplemental flow space forms the extension space, the supplemental flow space including a horizontal part extending from the circumferential part of the body toward the rear of the vehicle and a vertical part extending outwardly from the outer peripheral edge of the body forming the vent hole in a height direction of the vehicle or a width direction of the vehicle, wherein a waveform part is formed at an end of the vertical part, the waveform part including an inner surface having a wave shape as the inner surface extends in a circumferential direction thereof, wherein a longest distance from the outer peripheral edge of the body forming the vent hole to the circumferential part of the body is defined as a first length, wherein a distance from the outer peripheral edge of the body forming the vent hole in a region where the supplemental flow space is formed to the circumferential part of the body is defined as a second length, and wherein the second length is 70% or less of the first length.

* * * * *